US007847761B2

(12) United States Patent
Yamamoto et al.

(10) Patent No.: US 7,847,761 B2
(45) Date of Patent: Dec. 7, 2010

(54) METHOD FOR DRIVING DISPLAY AND DISPLAY

(75) Inventors: Tetsuro Yamamoto, Kanagawa (JP); Katsuhide Uchino, Kanagawa (JP); Junichi Yamashita, Tokyo (JP)

(73) Assignee: Sony Corporation, Tokyo (JP)

( * ) Notice: Subject to any disclaimer, the term of this patent is extended or adjusted under 35 U.S.C. 154(b) by 797 days.

(21) Appl. No.: 11/549,174

(22) Filed: Oct. 13, 2006

(65) Prior Publication Data

US 2007/0109232 A1 May 17, 2007

(30) Foreign Application Priority Data

Oct. 13, 2005 (JP) ..... P2005-298494

(51) Int. Cl.
*G09G 3/30* (2006.01)

(52) U.S. Cl. ..... 345/76

(58) Field of Classification Search ..... 345/76
See application file for complete search history.

(56) References Cited

U.S. PATENT DOCUMENTS 6,348,906 B1 * 2/2002 Dawson et al. ..... 345/82
2004/0066357 A1 * 4/2004 Kawasaki ..... 345/76

FOREIGN PATENT DOCUMENTS

JP 2004-361640 12/2004
JP 2004361640 A * 12/2004
JP 2005195756 A * 7/2005
JP 2005-345722 12/2005
JP 2005345722 A * 12/2005

* cited by examiner

*Primary Examiner*—Richard Hjerpe
*Assistant Examiner*—Dorothy Webb
(74) *Attorney, Agent, or Firm*—SNR Denton US LLP

(57) ABSTRACT

In an embodiment of the present invention, for an active-matrix organic EL display in which pixel circuits each including five transistors and one capacitor are two-dimensionally arranged in rows and columns, the timing of transition of a drive signal DS from the "H" level to the "L" level is brought close to the timing of transition of a write signal WS from the "L" level to the "H" level. Furthermore, the active period of a first auto-zero signal AZ1 is overlapped with the active period of the write signal WS. This timing relationship achieves suppression of variation in the source voltage and gate voltage of a drive transistor due to leakage currents, in addition to realization of a function to compensate variation in the characteristic of an organic EL element and a function to compensate variation in the threshold voltage Vth of the drive transistor with a small number of components. Thus, a uniform image quality free from image unevenness can be achieved.

4 Claims, 11 Drawing Sheets

Reference Example

Reference Example

Reference Example

Reference Example

Reference Example

Reference Example

Reference Example

Reference Example

Reference Example

Reference Example FIG. 12

METHOD FOR DRIVING DISPLAY AND DISPLAY

CROSS REFERENCES TO RELATED APPLICATIONS

This application contains subject matter related to Japanese Patent Application JP 2005-298494 filed with the Japanese Patent Office on Oct. 13, 2005, the entire contents of which being incorporated herein by reference.

BACKGROUND OF THE INVENTION

1. Field of the Invention

The present invention relates to a method for driving a display and a display, and particularly to a method for driving a display in which pixel circuits each including an electro-optical element are arranged in rows and columns (in a matrix), and a display.

2. Description of the Related Art

In recent years, development and commercialization of organic electro luminescence (EL) displays have been advanced. In the organic EL display, a large number of pixel circuits are arranged in a matrix, and each pixel circuit includes an organic EL element, which is a so-called current-driven light-emitting element of which emission luminance varies depending on the current value, as an electro-optical element. Since the organic EL element is a self-luminous element, the organic EL display has advantages such as high image visibility, no backlight, and high response speed over a liquid crystal display, which controls the intensity of light from a light source (backlight) by use of pixel circuits each including a liquid crystal cell.

As the driving system for the organic EL display, a simple-(passive) matrix system or an active-matrix system can be employed, similarly to the liquid crystal display. However, a display of the simple-matrix system involves a problem that it is difficult to realize a large-size and high-definition display and other problems although the configuration thereof is simple. For that reason, in recent years, development of displays of the active-matrix system has been actively promoted. In the active-matrix display, the current flowing through a light-emitting element is controlled by an active element such as an insulated gate field effect transistor (typically, thin film transistor; TFT) provided in the same pixel circuit as that including the light-emitting element.

If N-channel transistors can be used as the thin film transistors (hereinafter, referred to as TFTs) that are included in pixel circuits as active elements, an existing amorphous silicon (a-Si) process can be used in fabrication of the TFTs. The use of an a-Si process can reduce costs of the TFT substrate.

In general, the current-voltage (I-V) characteristic of an organic EL element deteriorates as the time passes (deteriorates with age). In a pixel circuit including N-channel TFTs, the source of the TFT for current-driving the organic EL element (hereinafter, referred to as a drive TFT) is connected to the organic EL element. Therefore, age deterioration of the I-V characteristic of the organic EL element leads to a change in the gate-source voltage Vgs of the drive TFT, which results in a change in the emission luminance of the organic EL element.

A more specific description will be made on this point. The source voltage of the drive TFT is determined depending on the operating point of the drive TFT and organic EL element. Deterioration of the I-V characteristic of the organic EL element varies the operating point of the drive TFT and organic EL element. Therefore, even when the same gate voltage is applied to the drive TFT, the source voltage of the drive TFT varies. Thus, the gate-source voltage Vgs of the drive TFT varies, and hence the value of the current flowing through the drive TFT varies. Accordingly, the value of the current flowing through the organic EL element also varies, which results in variation in the emission luminance of the organic EL element.

Furthermore, in addition to the age deterioration of the I-V characteristic of the organic EL element, the pixel circuit including N-channel TFTs involves a change in the threshold voltage Vth of the drive TFT with time and variation in the threshold voltage Vth from pixel to pixel. The difference in the threshold voltage Vth of the drive TFT leads to variation in the value of the current flowing through the drive TFT. Accordingly, even when the same gate voltage is applied to the drive TFT, the emission luminance of the organic EL element varies.

An existing related art employs a configuration in which each of pixel circuits is provided with a function to compensate variation in the characteristic of the organic EL element and a function to compensate variation in the threshold voltage Vth of the drive TFT so that the emission luminance of the organic EL element is not affected but kept constant even when the I-V characteristic of the organic EL element deteriorates with age and the threshold voltage Vth of the drive TFT changes over time (refer to e.g. Japanese Patent Laid-open No. 2004-361640). The related art according to this patent document will be described below.

FIG. 1 is a circuit diagram showing the configurations of an active-matrix display and pixel circuits used in the display according to the related art. The active-matrix display of the related art includes a pixel array 102 in which a large number of pixel circuits 101 each including a current-driven light-emitting element such as an organic EL element are arranged in a matrix. FIG. 1 shows the specific circuit configuration of certain one pixel circuit 101 for simplified illustration.

In the pixel array 102, for the respective pixel circuits 101, scan lines 103, first and second drive lines 104 and 105, and auto-zero lines 106 are provided on each row basis, and data lines 107 are provided on each column basis. Arranged in the periphery of the pixel array 102 are a write scanning circuit 108 that drives the scan lines 103, first and second drive scanning circuits 109 and 110 that drive the first and second drive lines 104 and 105, respectively, an auto-zero circuit 111 that drives the auto-zero lines 106, and a data line drive circuit 112 that supplies the data lines 107 with data signals dependent upon luminance information.

The pixel circuit 101 includes, as its components, an organic EL element 201, a drive transistor 202, capacitors (storage capacitors) 203 and 204, a sampling transistor 205 and switching transistors 206 to 209. As the drive transistor 202, the sampling transistor 205 and the switching transistors 206 to 209, e.g. N-channel field effect TFTs are used. Hereinafter, the drive transistor 202, the sampling transistor 205 and the switching transistors 206 to 209 are referred to as a drive TFT 202, a sampling TFT 205 and switching TFTs 206 to 209, respectively.

The cathode electrode of the organic EL element 201 is coupled to a ground potential GND. The drive TFT 202 is a transistor that drives the organic EL element 201 to emit light, and the source thereof is connected to the anode electrode of the organic EL element 201, which leads to formation of a source follower circuit. The capacitor 203 is a storage capacitor. One electrode thereof is connected to the gate of the drive TFT 202, while the other electrode thereof is connected to a connecting node N101 between the source of the drive TFT 202 and the anode electrode of the organic EL element 201.

One terminal of the sampling TFT 205 is connected to the data line 107, the other terminal thereof is coupled to the gate of the drive TFT 202, and the gate thereof is connected to the scan line 103. One electrode of the capacitor 204 is connected to a node N104, while the other electrode thereof is connected to a connecting node N102 between the gate of the drive TFT 202 and one electrode of the capacitor 203. The drain of the switching TFT 206 is connected to the connecting node N101, and the source thereof is coupled to a supply potential Vss.

The drain of the switching TFT 207 is coupled to a positive supply potential Vcc, the source thereof is connected to the drain of the drive TFT 202, and the gate thereof is connected to the second drive line 105. One terminal of the switching TFT 208 is connected to a connecting node N103 between the drain of the drive TFT 202 and the source of the switching TFT 207, the other terminal thereof is connected to the connecting node N102, and the gate thereof is connected to the auto-zero line 106. One terminal of the switching TFT 209 is coupled to a predetermined potential Vofs, the other terminal thereof is connected to the node N104, and the gate thereof is connected to the auto-zero line 106.

In the following, a description will be made on the circuit operation of an active-matrix organic EL display in which the pixel circuits 101 each having the above-described configuration are two-dimensionally arranged in a matrix with reference to the timing chart of FIG. 2.

When the pixel circuit 101 on a certain row is driven, a write signal WS is supplied to the pixel circuit 101 from the write scanning circuit 108 via the scan line 103, and first and second drive signals DS1 and DS2 are supplied to the pixel circuit 101 from the first and second drive scanning circuits 109 and 110 via the first and second drive lines 104 and 105, respectively. Furthermore, an auto-zero signal AZ is supplied to the pixel circuit 101 from the auto-zero circuit 111 via the auto-zero line 106. FIG. 2 shows the timing relationship among these signals.

In a normal emission state, the write signal WS output from the write scanning circuit 108, the drive signal DS1 output from the first drive scanning circuit 109, and the auto-zero signal AZ output from the auto-zero circuit 111 are at the "L" level, while the drive signal DS2 output from the second drive scanning circuit 110 is at the "H" level. Therefore, the sampling TFT 205 and the switching TFTs 206, 208 and 209 are in the off-state, while the switching TFT 207 is in the on-state.

At this time, the drive TFT 202 operates as a constant current source since it is designed so as to operate in the saturation region. As a result, a constant current Ids expressed by Equation (1) is supplied from the drive TFT 202 to the organic EL element 201.

$$Ids=(1/2)\cdot\mu(W/L)Cox(Vgs-|Vth|)^2 \quad (1)$$

In Equation (1), Vth is the threshold voltage of the drive TFT 202, μ is the carrier mobility, W is the channel width, L is the channel length, Cox is the gate capacitance per unit area, and Vgs is the gate-source voltage.

When the switching TFT 207 is in the on-state, both the drive signal DS1 output from the first drive scanning circuit 109 and the auto-zero signal AZ output from the auto-zero circuit 111 are turned to the "H" level, and hence the switching TFTs 206, 208 and 209 enter the on-state. Thus, the supply potential Vss is applied to the anode electrode of the organic EL element 201, while the supply potential Vcc is applied to the gate of the drive TFT 202.

At this time, if the supply potential Vss is lower than the sum between the cathode voltage Vcat of the organic EL element 201 (ground potential GND, in this example) and the threshold voltage Vthel of the organic EL element 201 (Vcat+Vthel), the organic EL element 201 becomes the non-emission state, which starts the non-emission period. The following description is based on an assumption that the relationship Vss≦Vcat+Vthel is satisfied and the supply potential Vss is at the GND level. When the non-emission period starts, since the switching TFTs 206 and 208 enter the on-state, the constant current Ids dependent upon the gate-source voltage Vgs flows through the path of Vcc→switching TFT 207→drive TFT 202→node N101→switching TFT 206→Vss.

Subsequently, the drive signal DS2 output from the second drive scanning circuit 110 is turned to the "L" level, so that the switching TFT 207 becomes the off-state and thus the operation time sequence enters a threshold cancel period for canceling (correcting) the threshold voltage Vth of the drive TFT 202. At this time, the drive TFT 202 operates in the saturation region since the gate and drain thereof are coupled to each other via the switching TFT 208. In addition, since the capacitors 203 and 204 are connected to the gate of the drive TFT 202 in parallel to each other, the gate-source voltage Vgs of the drive TFT 202 gradually decreases as the time passes.

After a certain period has passed, the gate-source voltage Vgs of the drive TFT 202 reaches the threshold voltage Vth of the drive TFT 202. At this time, a voltage of (Vofs−Vth) is charged to the capacitor 204, while a voltage of Vth is charged to the capacitor 203. Subsequently, when the sampling TFT 205 and the switching TFT 207 are in the off-state and the switching TFT 206 is in the on-state, the auto-zero signal AZ output from the auto-zero circuit 111 is changed from the "H" level to the "L" level. Thus, the switching TFTs 208 and 209 enter the off-state, which corresponds to the end of the threshold cancel period. At this time, the capacitor 204 holds the voltage of (Vofs−Vth), while the capacitor 203 holds the voltage of Vth.

Subsequently, when the sampling TFT 205 and the switching TFTs 207, 208 and 209 are in the off-state and the switching TFT 206 is in the on-state, the write signal WS output from the write scanning circuit 108 is turned to the "H" level, which starts a writing period. In the writing period, the sampling TFT 205 is in the on-state, which allows writing of an input signal voltage Vin supplied through the data line 107. Specifically, by turning on the sampling TFT 205, the input signal voltage Vin is loaded onto the connecting node N104 among one terminal of the TFT 205, one electrode of the capacitor 204 and the source of the TFT 209, so that a voltage variation amount ΔV at the connecting node N104 is coupled to the gate of the drive TFT 202 via the capacitor 204.

At this time, the gate voltage Vg of the drive TFT 202 is equal to the threshold voltage Vth, and the coupling amount ΔV is determined depending on the capacitance C1 of the capacitor 203, the capacitance C2 of the capacitor 204, and the parasitic capacitance C3 of the drive TFT 202 as expressed by Equation (2).

$$\Delta V=\{C2/(C1+C2+C3)\}\cdot(Vin-Vofs) \quad (2)$$

Therefore, if the capacitances C1 and C2 of the capacitors 203 and 204 are set sufficiently larger than the parasitic capacitance C3 of the drive TFT 202, the amount ΔV of the coupling to the gate of the drive TFT 202 is not affected by the threshold voltage Vth of the drive TFT 202 but determined depending only on the capacitances C1 and C2 of the capacitors 203 and 204.

When the write signal WS output from the write scanning circuit 108 is changed from the "H" level to the "L" level and hence the sampling TFT 205 is turned off, the period for writing the input signal voltage Vin ends. After the end of the writing period, when the sampling TFT 205 and the switching TFTs 208 and 209 are in the off-state, the drive signal DS1 output from the first drive scanning circuit 109 is switched to the "L" level, which turns off the switching TFT 206. Subsequently, the drive signal DS2 output from the second drive scanning circuit 110 is switched to the "H" level, which turns on the switching TFT 207.

The turning-on of the switching TFT 207 leads to a rise in the drain potential of the drive TFT 202 to the supply potential Vcc. Since the gate-source voltage Vgs of the drive TFT 202 is constant, the drive TFT 202 supplies the constant current Ids to the organic EL element 201. At this time, the potential at the connecting node N101 rises to a voltage Vx that permits the constant current Ids to flow through the organic EL element 201, which results in the light emission of the organic EL element 201.

Also in the pixel circuit 101 that executes the above-described series of operation, the I-V characteristic of the organic EL element 201 changes as the total emission period thereof becomes longer. Therefore, the potential at the connecting node N101 also changes.

However, since the gate-source voltage Vgs of the drive TFT 202 is kept at a constant value, the value of the current flowing through the organic EL element 201 does not change. Therefore, even when the I-V characteristic of the organic EL element 201 deteriorates, the constant current Ids invariably continues to flow, which causes no change in the emission luminance of the organic EL element 201. Furthermore, due to the operation of the switching TFT 208 in the threshold cancel period, the threshold voltage Vth of the drive TFT 202 can be cancelled, so that the constant current Ids that is not affected by variation in the threshold voltage Vth can be applied to the organic EL element 201, which allows achievement of high-quality images.

As described above, in the related art, each of the pixel circuits 101 is provided with a function to compensate variation in the I-V characteristic of the organic EL element 201 and a function to compensate variation in the threshold voltage Vth of the drive TFT 202. Thus, even when the I-V characteristic of the organic EL element 201 deteriorates with age and the threshold voltage Vth of the drive TFT 202 changes over time, the emission luminance of the organic EL element 201 can be kept constant without being affected by these changes. However, each pixel circuit 101 is composed of six transistors 202, and 205 to 209 and two capacitors 203 and 204, and hence involves a problem that the number of the components therein is large.

SUMMARY OF THE INVENTION

There is a need for the present invention to provide a method for driving a display and a display that both can achieve a uniform image quality free from image unevenness, with allowing each pixel circuit including a smaller number of components to have a function to compensate a change in the characteristic of an electro-optical element such as an organic EL element and a function to compensate a change (variation from pixel to pixel) in the threshold voltage Vth of a TFT for driving the electro-optical element.

According to one embodiment of the present invention, there is provided a display having the following configuration. Specifically, the display includes a pixel array in which pixel circuits are arranged in rows and columns. Each of the pixel circuits includes an electro-optical element (EL) of which one end (K: cathode) is connected to a first supply potential (GND in FIG. 3), a drive transistor (32 in FIG. 3) that has the source connected to the other end (A: anode) of the electro-optical element and is formed of an N-channel thin film transistor, a sampling transistor (33 in FIG. 3) that is connected between a data line (17 in FIG. 3) and the gate of the drive transistor and captures an input signal dependent upon luminance information from the data line. Each of the pixel circuits further includes a first switching transistor ((1) in FIG. 3) connected between the drain of the drive transistor (32) and a second supply potential (Vcc in FIG. 3), a second switching transistor ((2) in FIG. 3) connected between the gate of the drive transistor (32) and a predetermined potential (Vofs in FIG. 3), a third switching transistor ((3) in FIG. 3) connected between the source of the drive transistor (32) and a third supply potential (Vss in FIG. 3), and a capacitor (37) connected between the gate and the source of the drive transistor (32).

In each pixel circuit, the first switching transistor (1) and the sampling transistor (33) are sequentially driven with a timing relationship in which the timing at which the first switching transistor (1) is turned to the non-conducting state is close to the timing at which the sampling transistor (33) is turned to the conducting state to the extent that overlapping between a non-conducting period of the first switching transistor (1) and a non-conducting period of the sampling transistor (33) is assured.

That is, for the display in which the pixel circuits each including five transistors and one capacitor are arranged in rows and columns, the timing relationship is designed so that the timing at which the first switching transistor (1) is turned to the non-conducting state is close to the timing at which the sampling transistor (33) is turned to the conducting state. This timing relationship can shorten the period during which the leakage current when the first switching transistor (1) is in the non-conducting state flows through the drive transistor (32) and the electro-optical element (EL). Thus, variation in the source voltage of the drive transistor (32) due to the leakage current can be suppressed.

An embodiment of the invention can shorten the period during which the leakage current when the first switching transistor (1) is in the non-conducting state flows through the drive transistor (32) and the electro-optical element (EL), and can shorten the period during which the leakage current when the electro-optical element (EL) is reverse biased flows through the electro-optical element (EL). Thus, the embodiment can suppress variation in the source voltage of the drive transistor (32). Furthermore, the embodiment prevents variation in the gate voltage of the drive transistor (32) due to the leakage current when the first switching transistor (1) is in the non-conducting state, and therefore can achieve a uniform image quality free from image unevenness.

DETAILED DESCRIPTION OF THE PREFERRED EMBODIMENTS

An embodiment of the present invention will be described in detail below with reference to the accompanying drawings.

Initially, a pixel circuit according to the prior application that has been proposed by the present assignee in the specification of Japanese Patent Laid-open No. 2005-345722 will be described below as a reference example. This pixel circuit realizes, with a smaller number of components, a function to compensate a change in the characteristic of an organic EL element and a function to compensate a change (variation from pixel to pixel) in the threshold voltage Vth of a drive TFT.

Reference Example

Figure 3:
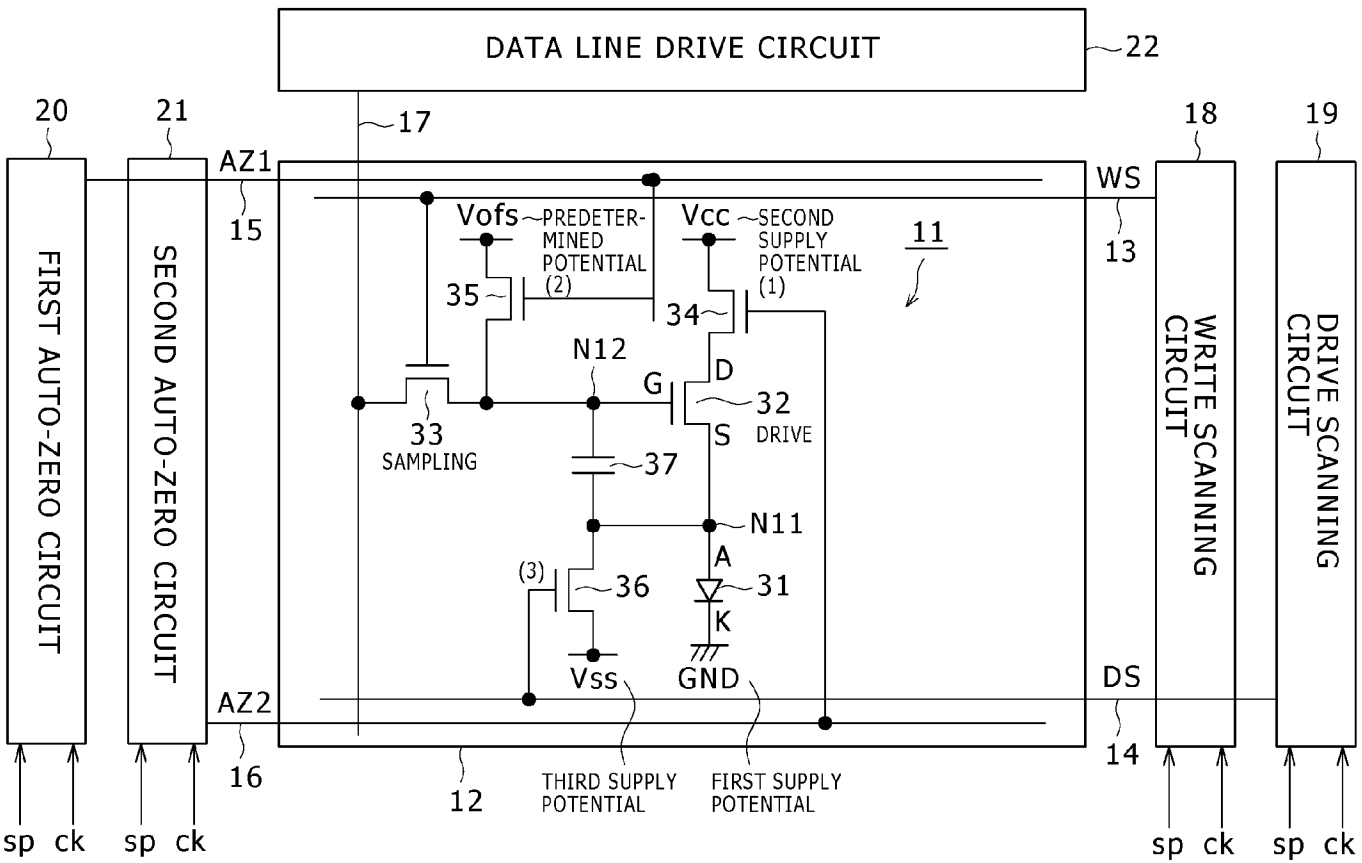
FIG. 3 is a circuit diagram showing the configurations of an active-matrix display and pixel circuits used in the display according to a reference example of the present invention.

FIG. 3 is a circuit diagram showing the configurations of an active-matrix display and pixel circuits used in the display according to the reference example. The active-matrix display of the reference example includes a pixel array 12 in which pixel circuits 11 each including an electro-optical element of which emission luminance varies depending on the current value, such as an organic EL element 31, are two-dimensionally arranged in rows and columns (in a matrix). FIG. 3 shows the specific circuit configuration of certain one pixel circuit 11 for simplified illustration.

In the pixel array 12, for the respective pixel circuits 11, scan lines 13, drive lines 14, and first and second auto-zero lines 15 and 16 are provided on each row basis, and data lines 17 are provided on each column basis. Arranged in the periphery of the pixel array 12 are a write scanning circuit 18 that drives the scan lines 13, a drive scanning circuit 19 that drives the drive lines 14, first and second auto-zero circuits 20 and 21 that drive the first and second auto-zero lines 15 and 16, respectively, and a data line drive circuit 22 that supplies the data lines 107 with data signals dependent upon luminance information.

In this example, the write scanning circuit 18 and the drive scanning circuit 19 are arranged on one side (e.g. the right side, in the drawing) of the pixel array 12, while the first and second auto-zero circuits 20 and 21 are arranged on the opposite side so that the pixel array 12 is sandwiched by these circuits. However, this arrangement relationship is merely one example, and the circuit configuration is not limited thereto. The write scanning circuit 18, the drive scanning circuit 19 and the first and second auto-zero circuits 20 and 21 start operation in response to a start pulse signal sp, and adequately output a write signal WS, a drive signal DS and first and second auto-zero signals AZ1 and AZ2, respectively, in sync with a clock pulse ck.

(Pixel Circuit)

Figure 1:
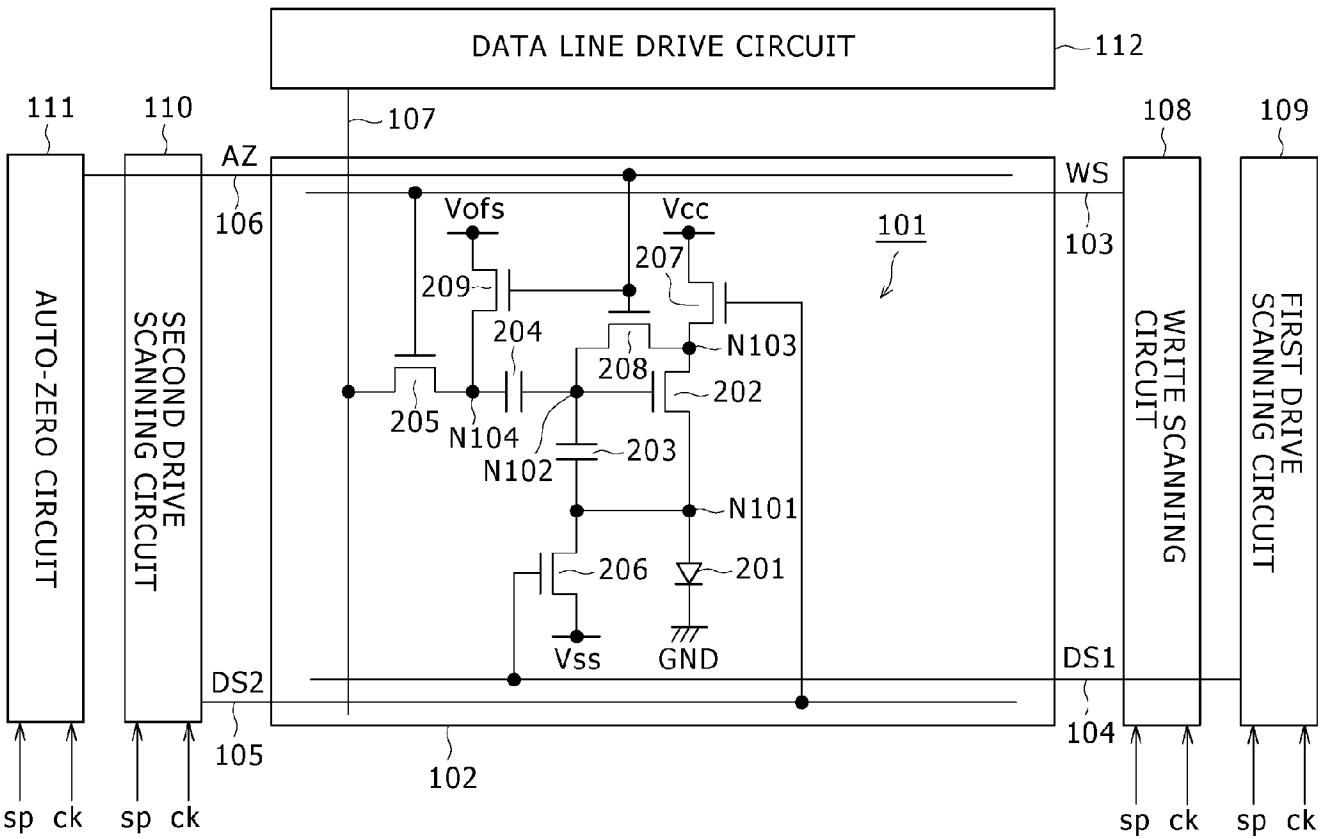
Prior Art FIG. 1
FIG. 1 is a circuit diagram showing the configurations of an active-matrix display and pixel circuits used in the display according to a related art.
Figure 2:
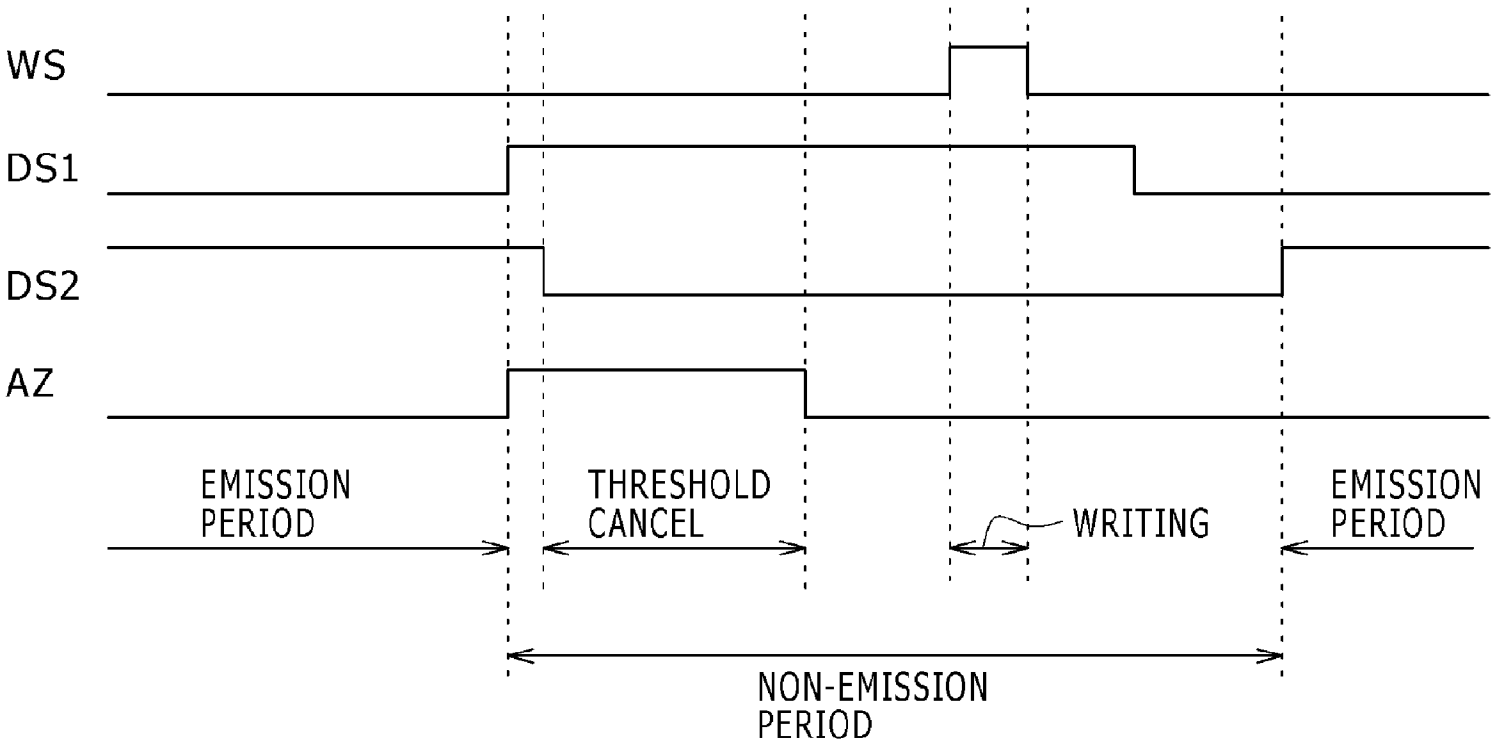
Prior Art FIG. 2
FIG. 2 is a timing chart for explaining the circuit operation of the pixel circuit of the related art.

The pixel circuit 11 includes, in addition to the organic EL element 31, a drive transistor 32, a sampling transistor 33, switching transistors 34 to 36, and a capacitor (storage capacitor) 37 as components of the circuit. That is, the pixel circuit 11 of the reference example is formed of five transistors 32 to 36 and one capacitor 37. Therefore, each of the number of transistors and the number of capacitors in the pixel circuit 11 is smaller by one than that in the pixel circuit 101 of the related art in FIG. 1.

In this pixel circuit 11, e.g. N-channel TFTs are used as the drive transistor 32, the sampling transistor 33 and the switching transistors 34 to 36. Hereinafter, the drive transistor 32, the sampling transistor 33 and the switching transistors 34 to 36 are referred to as a drive TFT 32, a sampling TFT 33 and switching TFTs 34 to 36, respectively.

The cathode electrode of the organic EL element 31 is coupled to a first supply potential (ground potential GND, in this example). The drive TFT 32 is a drive transistor that current-drives the organic EL element 31, and the source thereof is connected to the anode electrode of the organic EL element 31, which leads to formation of a source follower circuit. The source of the sampling TFT 33 is connected to the data line 17, the drain thereof is connected to the gate of the drive TFT 32, and the gate thereof is connected to the scan line 13.

The drain of the switching TFT 34 is coupled to a second supply potential Vcc (positive supply potential, in this example), the source thereof is connected to the drain of the drive TFT 32, and the gate thereof is connected to the drive line 14. One terminal of the switching TFT 35 is coupled to a predetermined potential Vofs, the other terminal thereof is connected to the drain of the sampling TFT 33 (gate of the drive TFT 32), and the gate thereof is connected to the first auto-zero line 15.

The drain of the switching TFT 36 is coupled to a connecting node N11 between the source of the drive TFT 32 and the anode electrode of the organic EL element 31, the source thereof is coupled to a third supply potential Vss(=GND, in this example), and the gate thereof is connected to the second auto-zero line 16. It is also possible to use a negative supply potential as the third supply potential Vss. One electrode of the capacitor 37 is coupled to a connecting node N12 between the gate of the drive TFT 32 and the drain of the sampling TFT 33, while the other electrode thereof is coupled to the connecting node N11 between the source of the drive TFT 32 and the anode electrode of the organic EL element 31.

In the pixel circuit 11 in which the respective components are connected to each other with the above-described connection relationship, the respective components operate as follows. Specifically, the sampling TFT 33 samples an input signal voltage Vsig supplied through the date line 17 when being turned to the on-(conducting) state. The sampled signal voltage Vsig is held by the capacitor 37. The switching TFT 34 supplies a current from the supply potential Vcc to the drive TFT 32 when being turned on.

The drive TFT 32 current-drives the organic EL element 31 depending on the signal voltage Vsig held by the capacitor 37. The switching TFTs 35 and 36 are adequately turned on so as to detect the threshold voltage Vth of the drive TFT 32 before the current-driving of the organic EL element 31 and store the detected threshold voltage Vth in the capacitor 37 in order to cancel the influence of the threshold voltage Vth in advance.

In the pixel circuit 11, as a condition for assuring normal operation, the third supply potential Vss is set lower than the potential obtained by subtracting the threshold voltage Vth of the drive TFT 32 from the predetermined potential Vofs. That is, the level relationship Vss<Vofs−Vth is satisfied. In addition, the level arising from addition of the threshold voltage Vthel of the organic EL element 31 to the cathode voltage Vcat of the organic EL element 31 (ground potential GND, in this example) is set higher than the level obtained by subtracting the threshold voltage Vth of the drive TFT 32 from the supply potential Vss. That is, the level relationship Vcat+Vthel>Vss−Vth is satisfied.

In the following, a description will be made on the circuit operation of an active-matrix organic EL display in which the pixel circuits 11 each having the above-described configuration are two-dimensionally arranged in a matrix with reference to the timing chart of FIG. 4 and the explanatory operation diagrams of FIGS. 5 to 10.

When the pixel circuit 11 on a certain row is driven, the write signal WS is supplied to the pixel circuit 11 from the write scanning circuit 18 via the scan line 13, and the drive signal DS is supplied to the pixel circuit 11 from the drive scanning circuit 19 via the drive line 14. Furthermore, the first and second auto-zero signals AZ1 and AZ2 are supplied to the pixel circuit 11 from the first and second auto-zero circuits 20 and 21 via the first and second auto-zero lines 15 and 16, respectively. FIG. 4 shows the timing relationship among these signals and changes in the gate voltage and source voltage of the drive TFT 32 in association with the timing relationship.

The "H" level state of the write signal WS, the drive signal DS and the first and second auto-zero signals AZ1 and AZ2 is defined as the active state thereof, while the "L" level state is defined as the inactive state. In the explanatory operation diagrams of FIGS. 5 to 10, the sampling TFT 33 and the switching TFTs 34 to 36 are represented by use of the symbol for a switch for simplified illustration.

(Emission Period)

Figure 5:
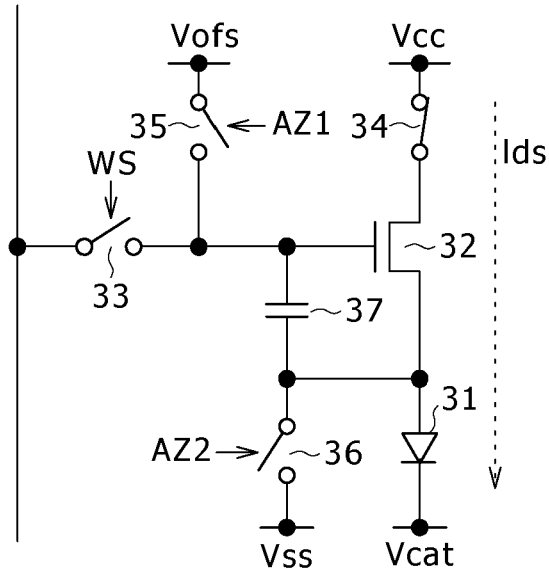
FIG. 5 is a first explanatory diagram for the operation of the pixel circuit of the reference example.

In a normal emission state, the write signal WS output from the write scanning circuit 18, and the first and second auto-zero signals AZ1 and AZ2 output from the first and second auto-zero circuits 20 and 21 are at the "L" level, while the drive signal DS output from the drive scanning circuit 19 is at the "H" level. Therefore, as shown in FIG. 5, the sampling TFT 33 and the switching TFTs 35 and 36 are in the off-state, while the switching TFT 34 is in the on-state. At this time, the drive TFT 32 operates as a constant current source since it is designed so as to operate in the saturation region. As a result, the constant current Ids expressed by the aforementioned Equation (1) is supplied from the switching TFT 34 via the drive TFT 32 to the organic EL element 31.

(Non-Emission Period)

Figure 6:
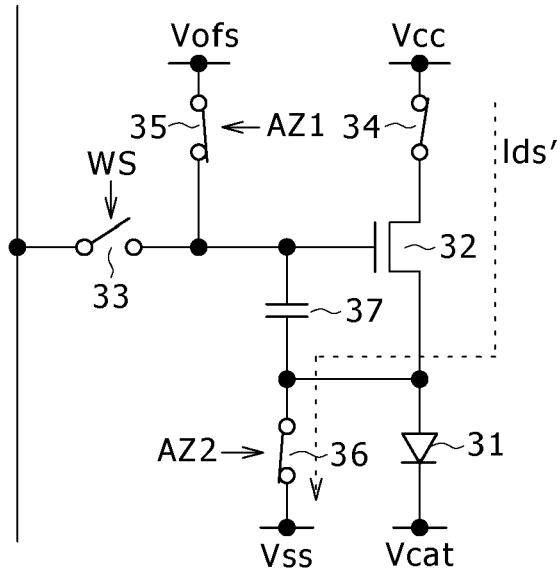
FIG. 6 is a second explanatory diagram for the operation of the pixel circuit of the reference example.
Figure 7:
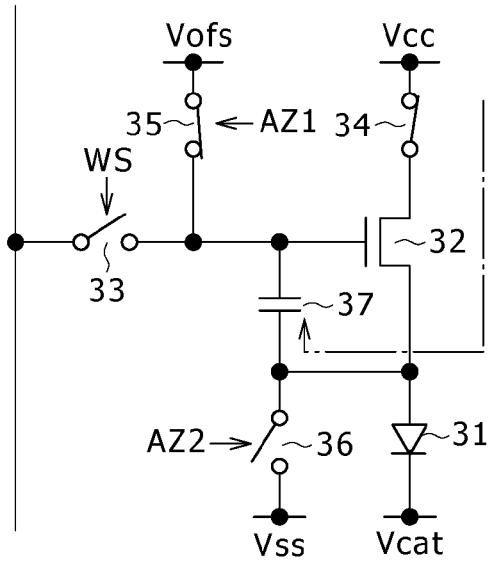
FIG. 7 is a third explanatory diagram for the operation of the pixel circuit of the reference example.
Figure 8:
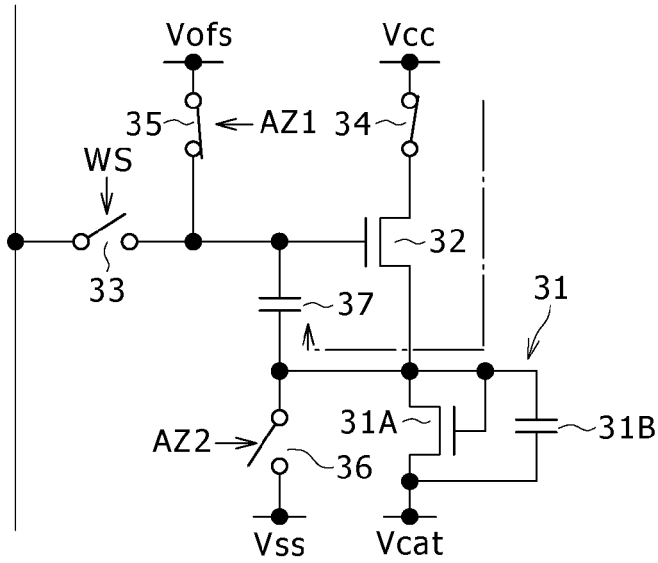
FIG. 8 is a fourth explanatory diagram for the operation of the pixel circuit of the reference example.

When the switching TFT 34 is in the on-state, both the first and second auto-zero signals AZ1 and AZ2 output from the first and second auto-zero circuits 20 and 21 are switched to the "H" level at time t1, which turns on the switching TFTs 35 and 36 as shown in FIG. 6. There is no limitation on the order of the turning-on of the switching TFTs 35 and 36. Due to the switching-on of the TFTs 35 and 36, the predetermined potential Vofs is applied to the gate of the drive TFT 32 via the switching TFT 35, and the supply potential Vss is applied to the anode electrode of the organic EL element 31 via the switching TFT 36.

At this time, the organic EL element 31 is reverse biased since the relationship Vss<Vcat+Vthel is satisfied as described above. Therefore, a current does not flow through the organic EL element 31, and hence the organic EL element 31 is in the non-emission state. Furthermore, the gate-source voltage Vgs of the drive TFT 32 takes a value of Vofs−Vss. Thus, a current Ids' corresponding to this value of Vofs−Vss flows through the path indicated by the dotted line in FIG. 6, i.e., the path of Vcc→switching TFT 34→drive TFT 32→node N11→switching TFT 36→Vss.

(Threshold Cancel Period)

At time t2, the auto-zero signal AZ2 output from the second auto-zero circuit 21 is turned to the "L" level. Thus, as shown in FIG126. 7, the switching TFT 36 becomes the off-state and thus the operation time sequence enters a threshold cancel period for canceling (correcting) the threshold voltage Vth of the drive TFT 32.

The turning-off of the switching TFT 36 blocks the path of the current Ids flowing through the drive TFT 32. The organic EL element 31 can be expressed by a diode 31A and a capacitor 31B as indicated by an equivalent circuit in FIG. 8. As long as the voltage Vel applied to the organic EL element 31 satisfies the relationship Vel<Vcat+Vthel (the leakage current of the organic EL element 31 is considerably smaller than the current flowing through the drive TFT 32) as described above, the current flowing through the drive TFT 32 charges the capacitors 37 and 31B.

Figure 11:
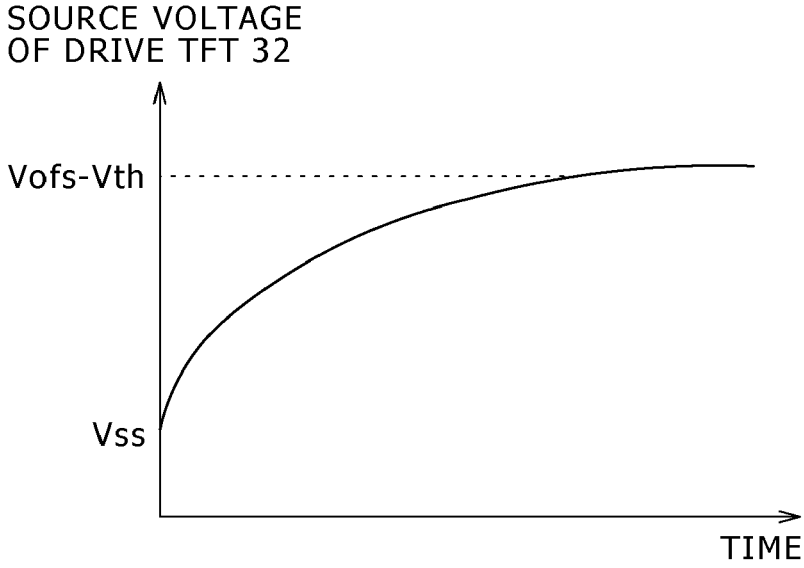
FIG. 11 is a characteristic diagram for explaining the operation of the pixel circuit of the reference example.

During this charging, the potential at the node N11, i.e., the source voltage Vel of the drive TFT 32, gradually rises as the time passes as shown in FIG. 11. After elapse of a certain period, when the potential difference between the nodes N11 and N12, i.e., the gate-source voltage Vgs of the drive TFT 32, becomes just the threshold voltage Vth, the drive TFT 32 is switched from the on-state to the off-state. This potential difference Vth between the nodes N11 and N12 is stored in the capacitor 37 as the potential for canceling (correcting) the threshold. At this time, the relationship Vel=Vofs−Vth<Vcat+Vthel is satisfied.

Figure 9:
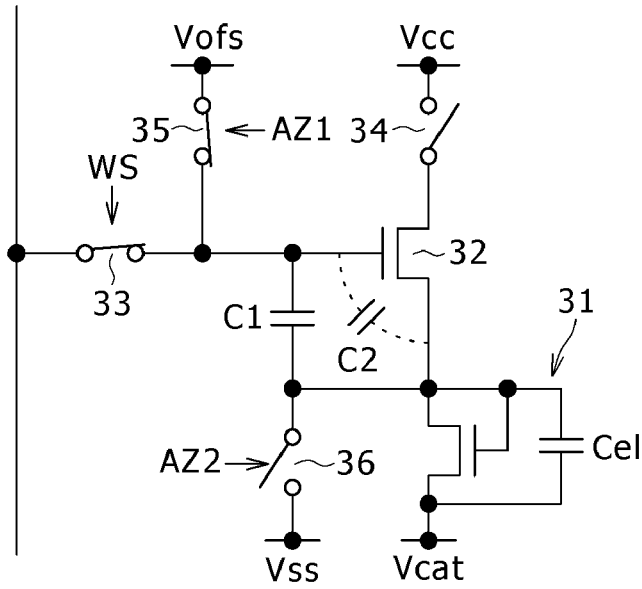
FIG. 9 is a fifth explanatory diagram for the operation of the pixel circuit of the reference example.

Thereafter, when the switching TFTs 34 and 35 are in the on-state and the switching TFT 36 is in the off-state, the drive signal DS output from the drive scanning circuit 19 and the auto-zero signal AZ1 output from the first auto-zero circuit 20 are sequentially switched from the "H" level to the "L" level at time t3 and time t4, respectively. Thus, as shown in FIG. 9, the switching TFTs 34 and 35 are sequentially turned off, which ends the threshold cancel period. The turning-off of the switching TFT 34 before that of the switching TFT 35 can suppress a change in the gate voltage of the drive TFT 32.

(Writing Period)

Subsequently, when the switching TFTs 34, 35 and 36 are in the off-state, the write signal WS output from the write scanning circuit 18 is turned to the "H" level at time t5. Thus, the sampling TFT 33 enters the on-state, which starts a period for writing the input signal voltage Vsig. In this writing period, the input signal voltage Vsig is sampled through the sampling TFT 33 so as to be written to the capacitor 37.

At this time, the signal voltage Vsig is stored in such a manner as to be added to the threshold voltage Vth held by the capacitor 37. As a result, variation in the threshold voltage Vth of the drive TFT 32 is invariably cancelled. That is, storing the threshold voltage Vth in the capacitor 37 in advance allows cancel (correction) of variation in the threshold voltage Vth, i.e., threshold cancel.

When the capacitance of the capacitor 37 is defined as C1, the capacitance of the capacitor 31B in the organic EL element 31 is defined as Cel, and the parasitic capacitance of the drive TFT 32 is defined as C2, the gate-source voltage Vgs of the drive TFT 32 is expressed by Equation (3).

$$Vgs=\{Cel/(Cel+C1+C2)\}\cdot(Vsig-Vofs)+Vth \quad (3)$$

In general, the capacitance Cel of the capacitor 31B in the organic EL element 31 is larger than the capacitance C1 of the capacitor 37 and the parasitic capacitance C2 of the drive TFT 32. Therefore, the gate-source voltage Vgs of the drive TFT 32 is approximately Vsig+Vth.

When the write signal WS output from the write scanning circuit 18 is changed from the "H" level to the "L" level at time t6 and hence the sampling TFT 33 is turned off, the period for writing the input signal voltage Vsig ends.

(Emission Period)

Figure 10:
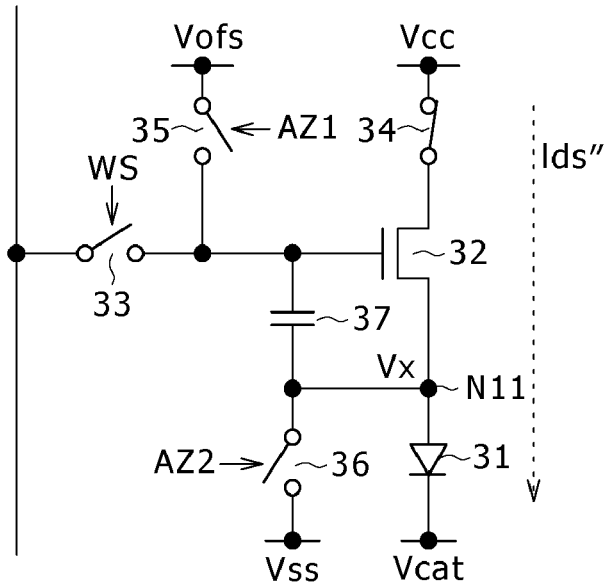
FIG. 10 is a sixth explanatory diagram for the operation of the pixel circuit of the reference example.

After the end of the writing period, when the sampling TFT 33 and the switching TFTs 35 and 36 are in the off-state, the drive signal DS output from the drive scanning circuit 19 is turned to the "H" level at time t7. Thus, as shown in FIG. 10, the switching TFT 34 enters the on-state, which starts an emission period.

The turning-on of the switching TFT 34 leads to a rise in the drain voltage of the drive TFT 32 to the supply potential Vcc. Since the gate-source voltage Vgs of the drive TFT 32 is constant, the drive TFT 32 supplies the constant current Ids" to the organic EL element 31. At this time, the anode voltage Vel of the organic EL element 31 rises to a voltage Vx that allows the constant current Ids" to flow through the organic EL element 31. As a result, the organic EL element 31 starts light emission operation.

The flowing of a current through the organic EL element 31 causes a voltage drop in the organic EL element 31, which raises the potential at the node N11. In association with this potential rise, the potential at the node N12 also rises. Therefore, the gate-source voltage Vgs of the drive TFT 32 is invariably kept at Vsig+Vth despite the potential rise at the node N11. As a result, the organic EL element 31 continues to emit light with the luminance dependent upon the input signal voltage Vsig.

Also in the pixel circuit 11 of the above-described reference example, the I-V characteristic of the organic EL element 31 changes as the total emission period thereof becomes longer. Accordingly, the potential at the connecting node N11 between the anode electrode of the organic EL element 31 and the source of the drive TFT 32 also changes. However, since the gate-source voltage Vgs of the drive TFT 32 is kept at a constant value, the current flowing through the organic EL element 31 does not change. Therefore, even when the I-V characteristic of the organic EL element 31 deteriorates, the constant current Ids invariably continues to flow, which causes no change in the emission luminance of the organic EL element 31 (function to compensate variation in the characteristic of the organic EL element 31).

Furthermore, the threshold voltage Vth of the drive TFT 32 is stored in the capacitor 37 in advance before writing of the input signal voltage Vsig. Thus, due to the operation of the switching TFTs 34 to 36 and the capacitor 37 in the threshold cancel period, the threshold voltage Vth of the drive TFT 32 can be cancelled, so that the constant current Ids that is not affected by variation in the threshold voltage Vth can be invariably applied to the organic EL element 31, which allows achievement of high-quality images (function to compensate variation in the threshold voltage Vth of the drive TFT 32).

A discussion will be made below about the period from the time t4, at which the switching TFT 35 is turned off, to the time t5, at which the writing starts, regarding the pixel circuit 11.

Figure 12:
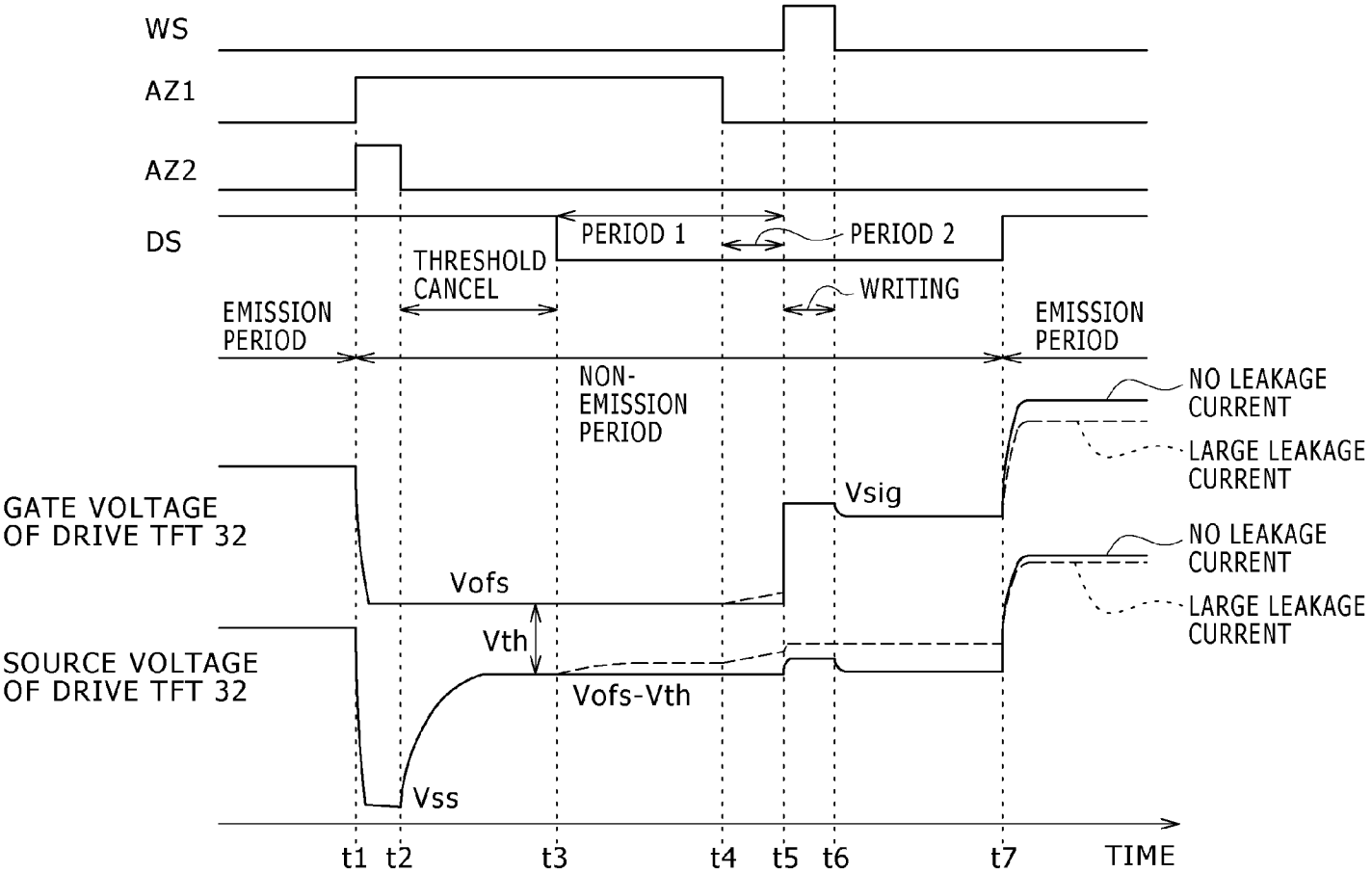
FIG. 12 is a timing chart for explaining a problem of the pixel circuit of the reference example.

If the leakage current when the switching TFT 34 is in the off-state and the leakage current of the organic EL element 31 are large, due to the flowing of the leakage current through the drive TFT 32 and the organic EL element 31 and the leakage current from the organic EL element 31, the source voltage of the drive TFT 32 rises in Period 1 in FIG. 12, and the gate voltage of the drive TFT 32 rises in Period 2 in FIG. 12. The variation in the magnitudes of the leakage currents causes variation in the gate voltage of the drive TFT 32 before the writing of the signal voltage Vsig, and hence leads to variation in the emission luminance of the organic EL element 31, which precludes achievement of a uniform image quality. In FIG. 12, the full lines indicate the gate voltage and source voltage of the drive TFT 32 when the leakage currents are absent, while the doted lines indicate those when the leakage currents are large.

Embodiment

According to an embodiment of the present invention, for an active-matrix organic EL display including the pixel circuits 11 that are two-dimensionally arranged in a matrix and each have the above-described configuration, i.e., each realize a function to compensate variation in the characteristic of the organic EL element 31 and a function to compensate variation in the threshold voltage Vth of the drive TFT 32 with a smaller number of components (five transistors 32 to 36 and one capacitor 37), the drive timing in the pixel circuits 11 is improved to thereby eliminate changes (variation) in the gate voltage and source voltage of the drive TFT 32, which occur before the writing of the signal voltage Vsig depending on variation in the magnitude of the leakage current when the switching TFT 34 is in the off-state.

In the pixel circuit 11 having the above-described configuration (pixel circuit according to the present embodiment), the drive TFT 32, the sampling TFT 33 and the switching TFTs 34 to 36 correspond to the drive transistor, the sampling transistor and the first to third switching transistors, respectively, set forth in the claims.

Figure 13:
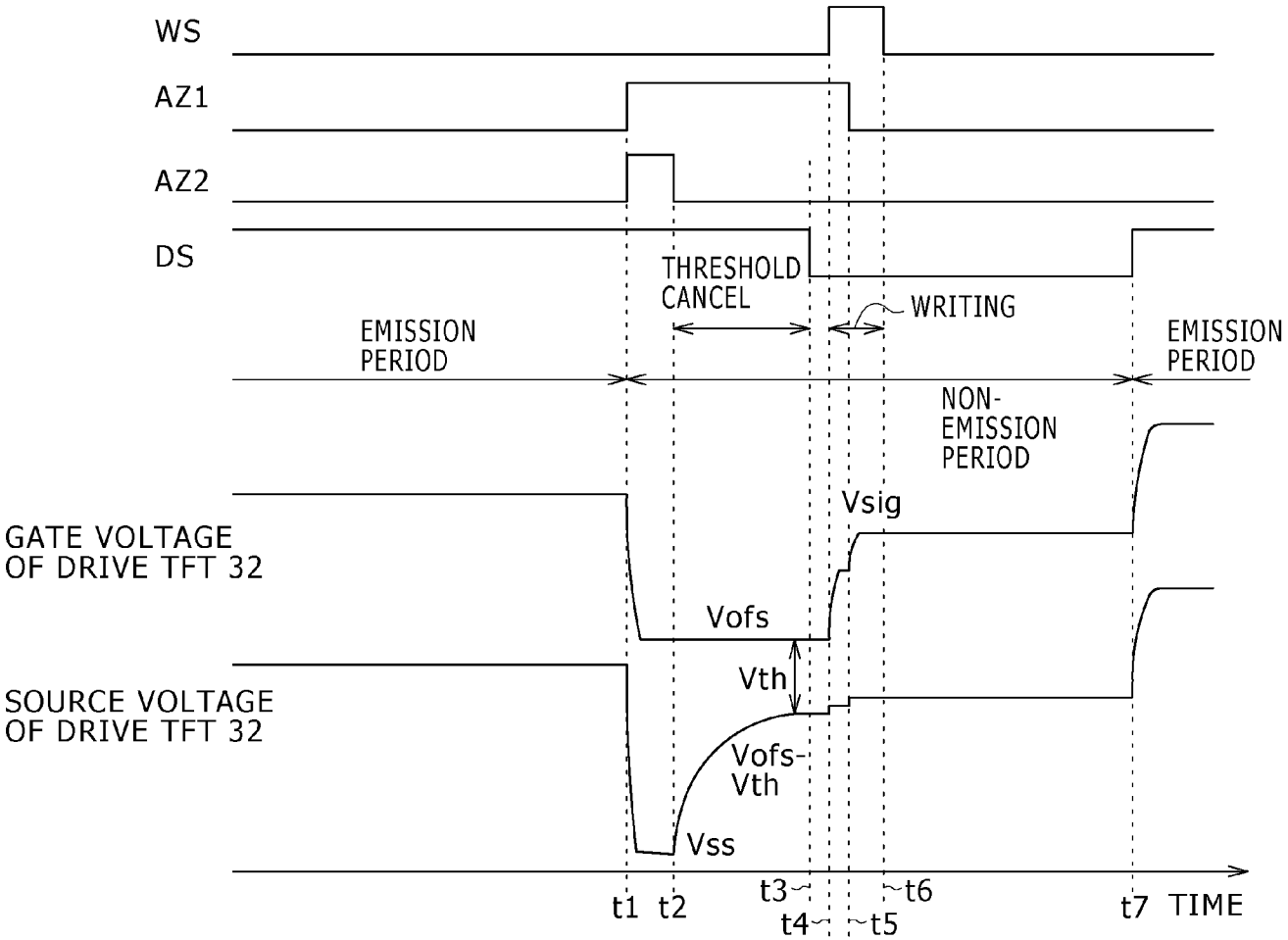
FIG. 13 is a timing chart showing drive timing according to one embodiment of the invention.

FIG. 13 is a timing chart that shows the drive timing according to one embodiment of the invention, i.e., the timing relationship among the write signal WS, the drive signal DS and the first and second auto-zero signals AZ1 and AZ2. The "H" level state of the write signal WS, the drive signal DS and the first and second auto-zero signals AZ1 and AZ2 is defined as the active state thereof, while the "L" level state is defined as the inactive state.

The first point of features of the drive timing of the present embodiment is that the following timing relationship is designed. Specifically, as shown in FIG. 13, the timing at which the switching TFT (first switching transistor) 34 is turned to the off-(non-conducting) state is brought as close as possible to the timing at which the sampling TFT (sampling transistor) 33 is turned to the on-(conducting) state to the extent that overlapping between the off-period of the switching TFT 34 and the off-period of the sampling TFT 33 is assured.

Figure 4:
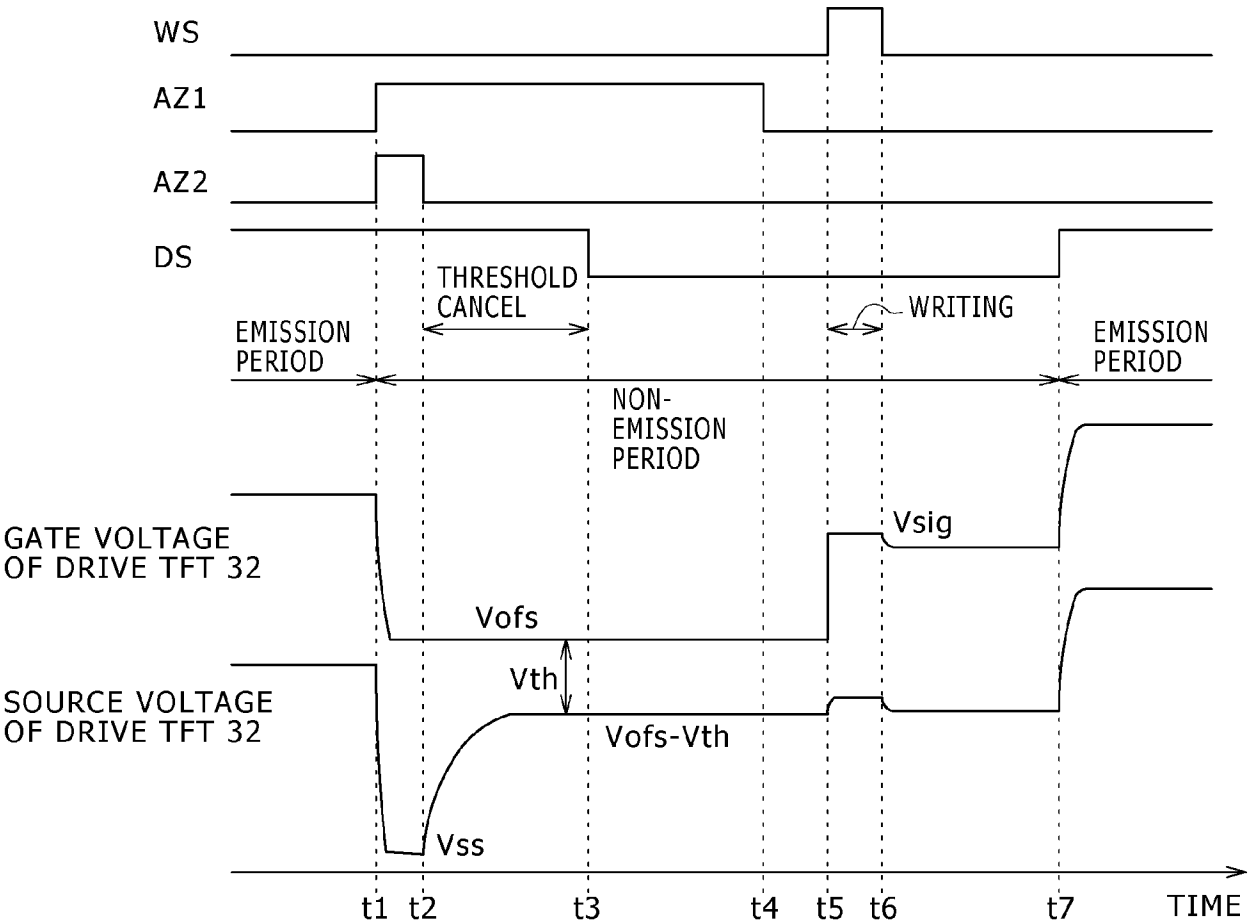
FIG. 4 is a timing chart for explaining the circuit operation of the pixel circuit of the reference example.

Specifically, compared with by the drive timing of the reference example in FIG. 4, the timing (time t3) at which the drive signal DS for driving the switching TFT 34 is switched from the active state to the inactive state, i.e., the timing of the transition of the drive signal DS from the "H" level to the "L" level, is brought closer to the timing (time t4) at which the write signal WS for driving the sampling TFT 33 is switched from the inactive state to the active state, i.e., the timing of the transition of the write signal WS from the "L" level to the "H" level.

Furthermore, the second point of features of the drive timing of the present embodiment is as follows. Specifically, the switching TFT 35 is turned off after the sampling TFT (sampling transistor) 33 is turned on when the switching TFT (first switching transistor) 34 is in the off-state and the switching TFT (second switching transistor) 35 is in the on-state.

Specifically, according to the drive timing of the present embodiment, the timing (time t5) at which the first auto-zero signal AZ1 for driving the switching TFT 35 is switched from the active state to the inactive state, i.e., the timing of the transition of the first auto-zero signal AZ1 from the "H" level to the "L" level, is set to be subsequent to the timing (time t4) of the transition of the write signal WS from the "L" level to the "H" level. Thus, the active period of the first auto-zero signal AZ1 is overlapped with the active period of the write signal WS.

(First Point)

A description will be made below on the first point. In general, the amount of a rise in the gate voltage and source voltage of the drive TFT 32 due to the leakage current when the switching TFT 34 is in the off-state is proportional to the length of the period during which the leakage current flows.

Therefore, by bringing the timing of the transition of the drive signal DS from the "H" level to the "L" level close to the timing of the transition of the write signal WS from the "L" level to the "H" level, the period during which the leakage current of the switching TFT 34 and the leakage current of the organic EL element 31 flow through the organic EL element 31 can be shortened compared with by the drive timing of the reference example in FIG. 4. Thus, the variation in the source voltage of the drive TFT 32 due to the leakage current can be suppressed, which allows achievement of a uniform image quality free from image unevenness.

Figure 14:
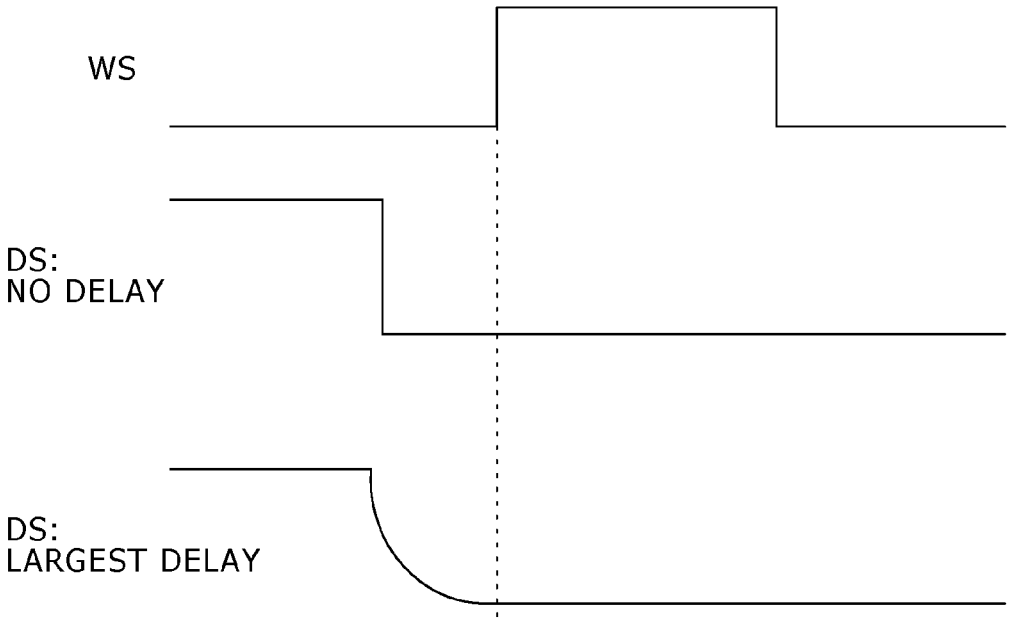
FIG. 14 is a waveform diagram showing a specific example of the drive timing of the embodiment.

The timing relationship between the drive signal DS and the write signal WS is designed so that, as shown in FIG. 14, the inactive periods thereof overlap with each other, i.e., overlapping between the off-periods of the switching TFT 34 and the sampling TFT 33 is assured, even in a pixel circuit that involves the largest delay of the drive signal DS due to influence of the wiring resistance, parasitic capacitance and so on in the display panel obtained by forming the pixel array 12 integrally with the peripheral drive circuits 18 to 22 on the same substrate.

(Second Point)

A description will be made below on the second point. According to the second point, the active period of the first auto-zero signal AZ1 is overlapped with the active period of the write signal WS to thereby eliminate the period during which the first auto-zero signal AZ1 is in the inactive state before the writing of the signal voltage Vsig, in which the write signal WS is in the active state. Thus, the gate voltage of the drive TFT 32 is kept at the predetermined potential Vofs until the writing operation. This feature eliminates the variation in the gate voltage of the drive TFT 32 due to the leakage current of the switching TFT 34, and hence can achieve a uniform image quality free from image unevenness.

In addition, due to the overlapping between the active periods of the first auto-zero signal AZ1 and the write signal WS, the gate voltage of the drive TFT 32 temporarily changes from the predetermined potential Vofs to an intermediate potential between the potential Vofs and the signal voltage Vsig before the writing of the signal voltage Vsig, and then reaches the signal voltage Vsig finally. The writing operation for the signal voltage Vsig is determined depending on the potential Vofs before the writing and the potential Vsig after the writing, as is apparent from the aforementioned Equation (3). Therefore, the overlapping between the active periods of the first auto-zero signal AZ1 and the write signal WS has no effect on the writing operation for the signal voltage Vsig.

In the above-described embodiment, for an active-matrix organic EL display including the pixel circuits 11 that are two-dimensionally arranged in a matrix and each have five transistors of the drive TFT 32, the sampling TFT 33 and the switching TFTs 34 to 36 and one capacitor 37, the drive timing is designed so that the timing of turning-off of the switching TFT 34 is brought as close as possible to the timing of turning-on of the sampling TFT 33 to the extent that overlapping between the off-periods of the switching TFT 34 and the sampling TFT 33 is assured. The embodiment can realize, with a small number of components, a function to compensate variation in the characteristic of the organic EL element 31 and a function to compensate variation in the threshold voltage Vth of the drive TFT 32. In addition, the embodiment can suppress variation in the source voltage of the drive TFT 32 due to flowing of the leakage currents of the switching TFT 34 and the organic EL element 31, and hence can achieve a uniform image quality free from image unevenness.

Furthermore, in the embodiment, the switching TFT 35 is turned to the off-state after the sampling TFT 33 is turned to the on-state when the switching TFT 34 is in the off-state and the switching TFT 35 is in the conducting state. That is, the active periods of the first auto-zero signal AZ1 and the write signal WS are overlapped with each other. Thus, in addition to the advantage of the realization of a function to compensate variation in the characteristic of the organic EL element 31 and a function to compensate variation in the threshold voltage Vth of the drive TFT 32 with a small number of components, the embodiment can offer an advantage of suppressing variation in the gate voltage of the drive TFT 32 due to flowing of the leakage currents of the switching TFT 34 and the organic EL element 31, and hence can achieve a uniform image quality free from image unevenness.

The circuit operation in the pixel circuit 11 of the embodiment for realizing the function to compensate variation in the characteristic of the organic EL element 31 and the function to compensate variation in the threshold voltage Vth of the drive TFT 32 is basically the same as that in the pixel circuit 11 of the reference example, and hence the description therefor is omitted.

The above-described embodiment is provided with a configuration that allows execution of both the first and second points. However, even with a configuration that can execute either one of these points, a uniform image quality free from image unevenness can be achieved.

In the above description of the embodiment, an explanation has been made on an example of application to an organic EL display that employs organic EL elements as electro-optical elements in the pixel circuits 11. However, the present invention is not limited to the application example but can be applied to overall displays that employ current-driven light-emitting elements of which emission luminance varies depending on the current value.

Furthermore, in the above description of the embodiment, an explanation has been made on an example in which N-channel TFTs are used as the drive transistor 32, the sampling transistor 33, and the switching transistors 34 to 36 included in each pixel circuit 11. However, the sampling transistor 33 and the switching transistors 34 to 36 do not necessarily need to be N-channel TFTs.

It should be understood by those skilled in the art that various modifications, combinations, sub-combinations and alterations may occur depending on design requirements and other factors insofar as they are within the scope of the appended claims or the equivalents thereof.

What is claimed is:

1. A method for driving a display including pixel circuits that are arranged in rows and columns with each pixel circuit having (a) an electro-optical element of which one end is connected to a first supply potential, (b) a drive transistor that has a source connected to the other end of the electro-optical element and is formed of an N-channel thin film transistor, (c) a sampling transistor that is connected between a data line and a gate of the drive transistor and captures an input signal dependent upon luminance information from the data line, (d) a first switching transistor connected between a drain of the drive transistor and a second supply potential, (e) a second switching transistor connected between the gate of the drive transistor and a predetermined potential, (f) a third switching transistor connected between the source of the drive transistor and a third supply potential, and (g) a capacitor connected between the gate and the source of the drive transistor, the method comprising the step of:

driving the second switching transistor and the sampling transistor sequentially but with a timing relationship such that the sampling transistor is in a conducting state for an entire period, the period including a length of time in which the second switching transistor is in a conducting state during the period and a length of time in which the second switching transistor is in a non-conducting state during the period, wherein the second switching transistor is left in a conducting state when the sampling transistor is turned on into a conducting state.

2. A method for driving a display including pixel circuits that are arranged in rows and columns with each having (a) an electro-optical element of which one end is connected to a first supply potential, (b) a drive transistor that has a source connected to the other end of the electro-optical element and is formed of an N-channel thin film transistor, (c) a sampling transistor that is connected between a data line and a gate of the drive transistor and captures an input signal dependent upon luminance information from the data line, (d) a first switching transistor connected between a drain of the drive transistor and a second supply potential, a second switching transistor connected between the gate of the drive transistor and a predetermined potential, (e) a third switching transistor connected between the source of the drive transistor and a third supply potential, and (f) a capacitor connected between the gate and the source of the drive transistor, the method comprising the step of:

turning the sampling transistor into a conducting state for an entire period, the period including a length of time in which the second switching transistor is in a conducting state during the period and a length of time in which the second transistor is in a non-conducting state during the period, and turning the second switching transistor to a non-conducting state during the period when the first switching transistor is in a non-conducting state.

3. A display comprising:

a pixel array configured to include pixel circuits that are arranged in rows and columns, each of the pixel circuits including an electro-optical element of which one end is connected to a first supply potential, a drive transistor that has a source connected to the other end of the electro-optical element and is formed of an N-channel thin film transistor, a sampling transistor that is connected between a data line and a gate of the drive transistor and captures an input signal dependent upon luminance information from the data line, a first switching transistor connected between a drain of the drive transistor and a second supply potential, a second switching transistor connected between the gate of the drive transistor and a predetermined potential, a third switching transistor connected between the source of the drive transistor and a third supply potential, and a capacitor connected between the gate and the source of the drive transistor; and a driver configured to drive the second switching transistor and the sampling transistor sequentially with a timing relationship such that the sampling transistor is in a conducting state for an entire period, the period including a length of time in which the second switching transistor is in a conducting state during the period and a length of time in which the second switching transistor is in a non-conducting state during the period, wherein the second switching transistor is turned to a non-conducting state after the sampling transistor is turned to a conducting state so that there is a period of overlap when both the second transistor and the sampling transistor are in a conducting state.

4. A display comprising:

a pixel array configured to include pixel circuits that are arranged in rows and columns, each of the pixel circuits including an electro-optical element of which one end is connected to a first supply potential, a drive transistor that has a source connected to the other end of the electro-optical element and is formed of an N-channel thin film transistor, a sampling transistor that is connected between a data line and a gate of the drive transistor and captures an input signal dependent upon luminance information from the data line, a first switching transistor connected between a drain of the drive transistor and a second supply potential, a second switching transistor connected between the gate of the drive transistor and a predetermined potential, a third switching transistor connected between the source of the drive transistor and a third supply potential, and a capacitor connected between the gate and the source of the drive transistor; and a driver configured to turn the sampling transistor into a conducting state for an entire period, the period including a length of time in which the second switching transistor is in a conducting state during the period and a length of time in which the second transistor is in a non-conducting state during the period, and turn the second switching transistor to a non-conducting state during the period when the first switching transistor is in a non-conducting state.

* * * * *